US008732898B2

(12) United States Patent
Fry et al.

(10) Patent No.: US 8,732,898 B2
(45) Date of Patent: May 27, 2014

(54) DOUBLE-WALLED VACUUM CLEANER

(75) Inventors: Kevin D. Fry, South Williamsport, PA (US); Robert L. Crevling, Jr., Cogan Station, PA (US)

(73) Assignee: Shop Vac Corporation, Williamsport, PA (US)

( * ) Notice: Subject to any disclaimer, the term of this patent is extended or adjusted under 35 U.S.C. 154(b) by 545 days.

(21) Appl. No.: 13/092,417

(22) Filed: Apr. 22, 2011

(65) Prior Publication Data

US 2012/0266407 A1 Oct. 25, 2012

(51) Int. Cl.
*A47L 5/00* (2006.01)
*A47L 9/00* (2006.01)

(52) U.S. Cl.
USPC ..... 15/327.2; 15/325

(58) Field of Classification Search
USPC ..... 15/327.2, 325
See application file for complete search history.

(56) References Cited

U.S. PATENT DOCUMENTS 3,609,946 A * 10/1971 Nakagawa et al. ..... 55/296

* cited by examiner

*Primary Examiner* — Bryan R Muller
(74) *Attorney, Agent, or Firm* — Marshall, Gerstein & Borun LLP

(57) ABSTRACT

A new drum vacuum cleaner has a 0.02 to 0.035 inch thick stainless steel wall that that substantially surrounds a molded inner tank that extends downwardly from a tank collar. The lower end of the wall is positioned between an inward-facing edge of a recess on a wheeled base and an outward-facing edge on the molded inner tank, and is supported on a supporting face on the base that also supports the tank. The upper end of the wall is positioned within a downward-opening slot in the tank collar. When the molded inner tank is connected to the base, the metal wall is trapped in place between the tank collar and the base, providing an exposed stainless steel section that is at least three inches in height and can extend to within less than 1" of the vacuum cleaner head.

11 Claims, 16 Drawing Sheets

DETAIL C
SCALE 2 : 1

DETAIL B
SCALE 2 : 1

SECTION A–A

DETAIL C
SCALE 1 : 1

DETAIL B
SCALE 1 : 1

DOUBLE-WALLED VACUUM CLEANER

CROSS-REFERENCE TO RELATED APPLICATIONS

Not applicable.

BACKGROUND OF THE INVENTION

The present invention relates generally to vacuum cleaners and more particularly to a structural arrangement for a drum-style vacuum cleaner that may provide a cost-effective way to give a domestic product a high-quality appearance.

The many different types of vacuum cleaners that are sold for domestic use can generally be categorized into three broad types: handheld vacuum cleaners; larger upright vacuum cleaners that roll on the floor and have an intake nozzle mounted on the floor; and drum-style (or canister) vacuum cleaners in which the tank of the vacuum cleaner is housed in unit that is separate from the intake nozzle. Most wet/dry vacuums take a "drum" form.

Drum-style vacuums sold for domestic use often have tanks made of plastic. Heavier-duty commercial vacuum cleaners sometimes have metal tanks, and some purchasers perceive metal (particularly stainless steel) as a more durable, higher-quality material. However, using stainless steel tank to build the tank of a drum vacuum cleaner sold for domestic use could add significantly to the cost of the product, driving its retail price too high for the marketplace.

Metal-colored stickers or foil can be used on a plastic tank to provide a metal appearance. However, stickers or foil are generally easily recognized as merely a cosmetic element, and may not significantly add to the perceived value of the product. The applicant is not aware of any prior arrangements of a tank on a drum vacuum that uses real stainless steel in a cost-effective way.

BRIEF SUMMARY

The applicants have developed new arrangement for a drum vacuum cleaner that may provide a cost-effective way to use real stainless steel on the tank of a drum-style vacuum cleaner. Like prior known vacuum cleaners, the new vacuum cleaner has a tank section that is carried by a base that rolls. The tank sits in a recess in the base. One or more connectors are used to connect a part of the tank to the base. A vacuum head is removably attached to an upper rim on a tank collar on the tank. The vacuum head houses a vacuum source that is in fluid communication with a reservoir within the molded inner tank. The vacuum source is also in fluid communication with both a vacuum inlet and an exhaust outlet.

Unlike prior known vacuum cleaners, the new vacuum cleaner has a metal wall that has a thickness of between 0.02 and 0.035 inches. This wall substantially surrounds a molded inner tank that extends downwardly from the tank collar. An upper edge of the metal wall fits against the tank collar. A lower edge of the metal wall fits within the recess in the base. When the molded inner tank is connected to the base, the metal wall is trapped in place between the tank collar and the base.

In one embodiment of the invention, the metal wall is made of stainless steel and has an exposed stainless steel section that is at least three inches in height, is visible to view by purchasers and users when the vacuum cleaner is fully assembled, has a horizontal boundary that fully surrounds the tank, and is free of any visible connectors.

In another embodiment of the invention, a stainless steel section extends even higher up the tank section, to within less than 1" of the vacuum cleaner head. This is accomplished by providing a cavity in the metal wall that partially surrounds the vacuum inlet.

In both illustrated embodiments, the lower end of the metal wall may be positioned between the inward-facing edge of the recess on the base and an outward-facing edge on the molded inner tank, and may be supported by a supporting face on the base that also supports the tank. The upper end of the metal wall may be positioned within a downward-opening slot in the tank collar. The metal wall itself may be arranged cylindrically and have a uniform gauge and a single, vertical seam.

BRIEF DESCRIPTION OF THE DRAWINGS

The invention may be better understood by referring to the accompanying drawings, in which.

DETAILED DESCRIPTION

Figure 1:
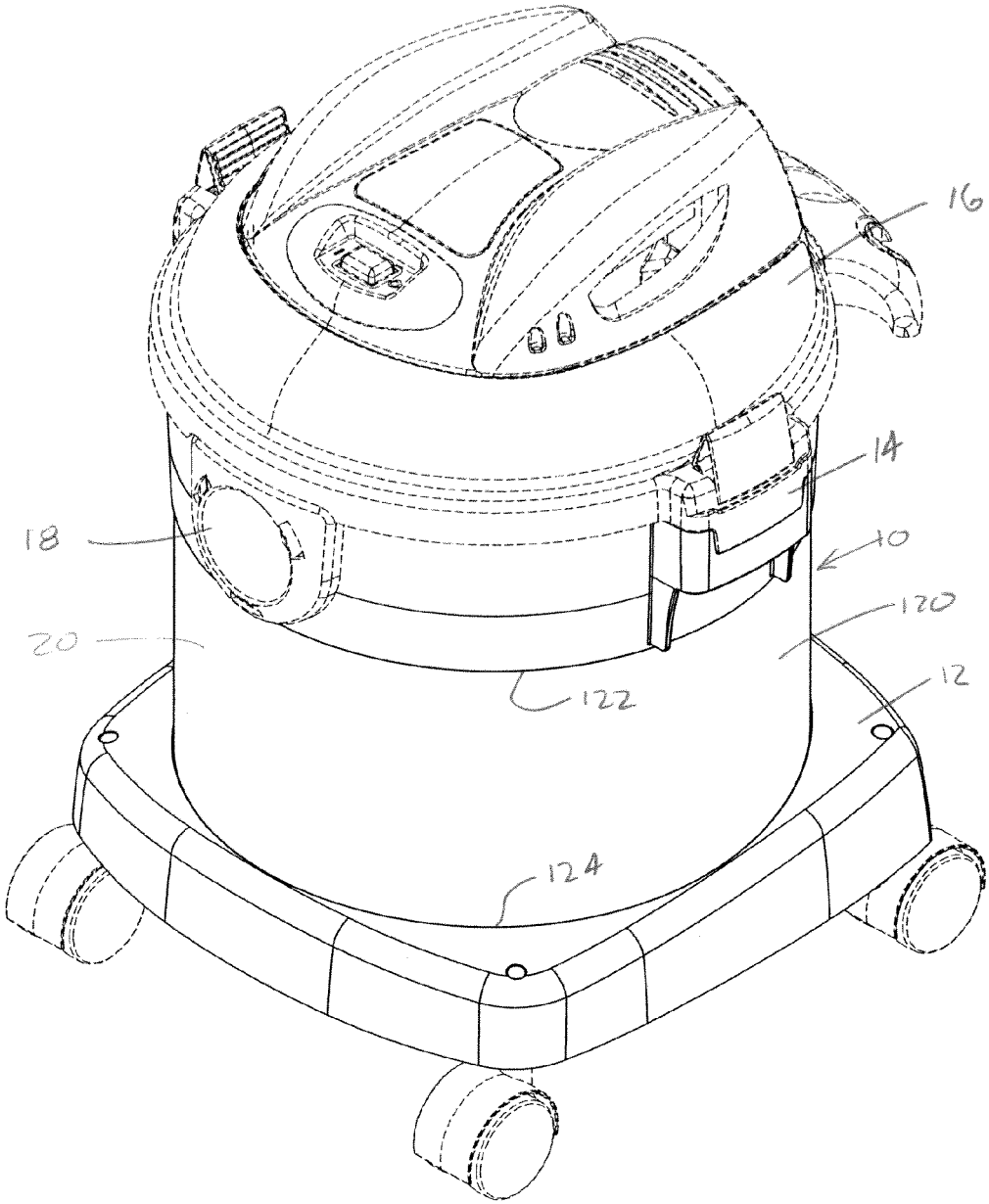
FIG. 1 is a perspective view of a vacuum cleaner that uses the new invention.
Figure 2:
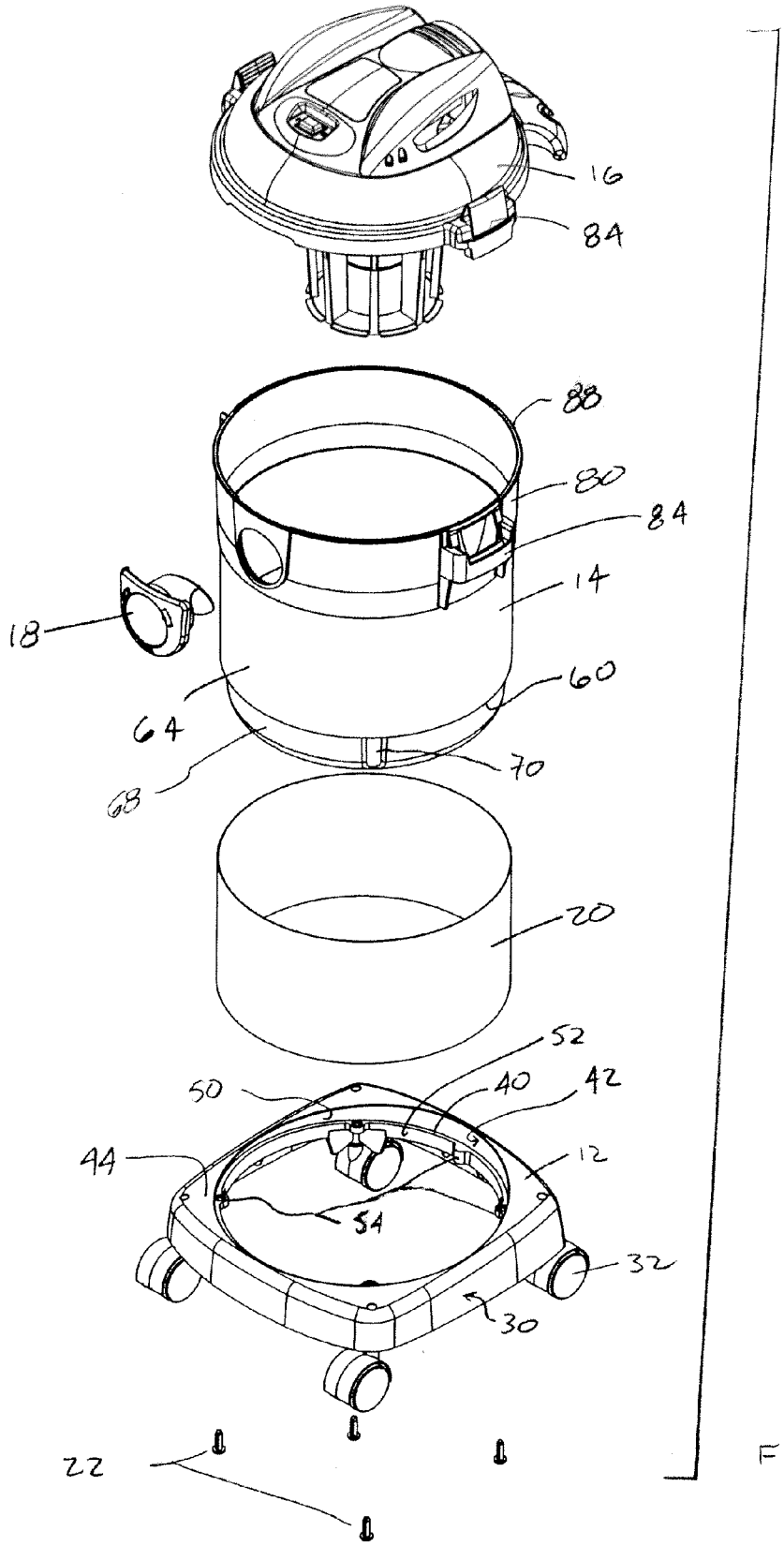
FIG. 2 is a reduced-scale exploded perspective view of the vacuum cleaner.
Figure 11:
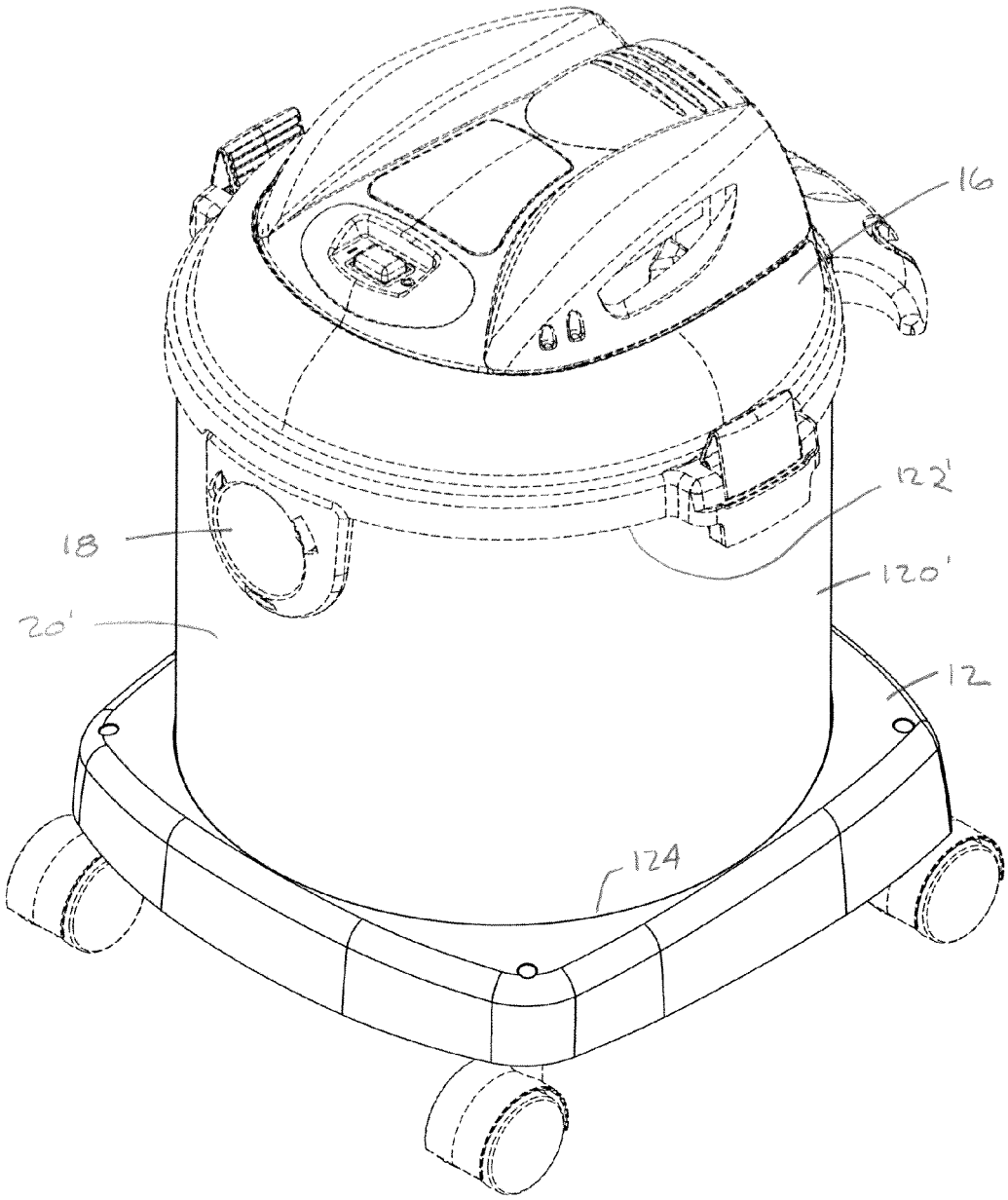
FIGS. 11-20 are views that correspond with FIGS. 1-10, respectively, and show an alternative embodiment of the invention.
Figure 12:
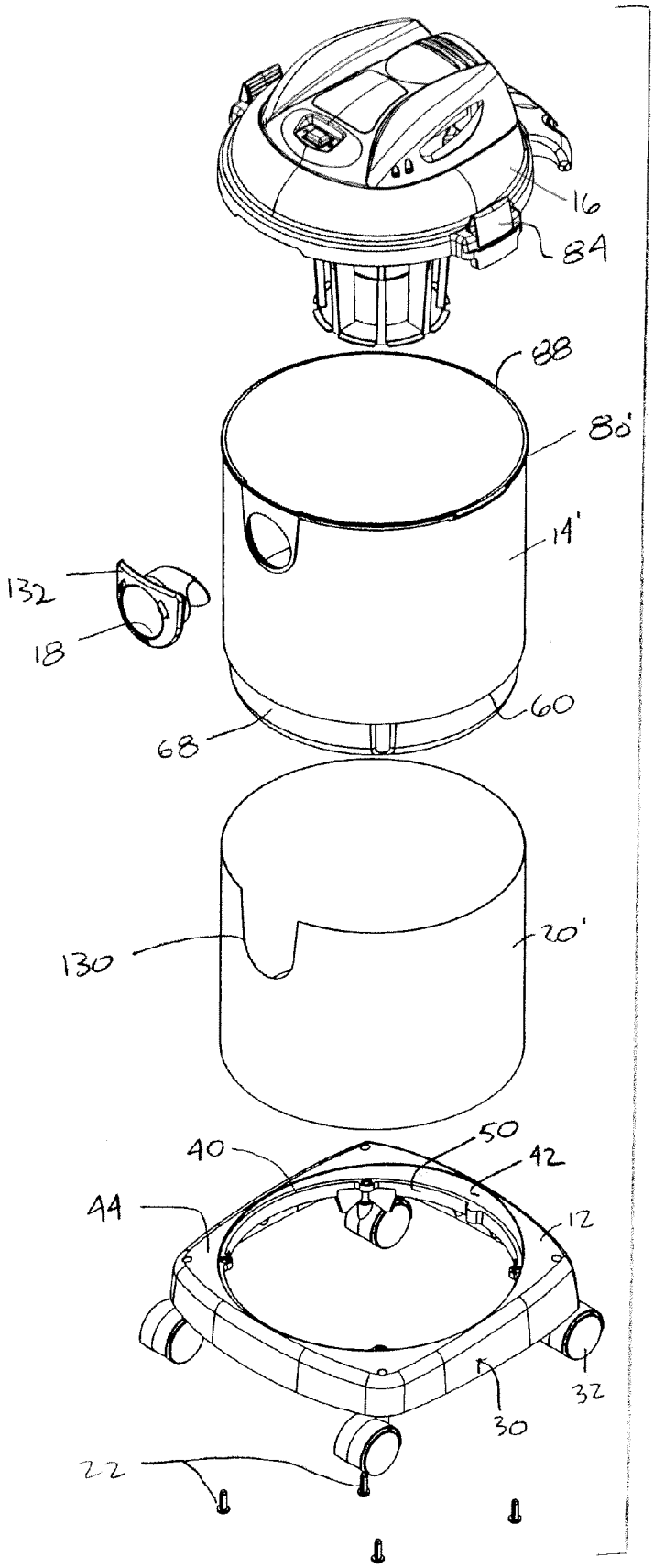

The vacuum cleaners 10 and 10' seen in FIGS. 1 and 11 are shown in exploded view in FIGS. 2 and 12. The vacuum cleaners are broken into six parts, a base 12, a tank section 14 or 14', a vacuum head 16, an inlet 18, a metal wall 20 or 20', and a set of connectors 22. Each of these parts will be discussed in turn.

The Base

The base 12 supports the other components of the vacuum cleaner 10 or 10' and enables the vacuum cleaner to be easily moved by a user. In these examples, the base takes the form of a seat 30 with wheels 32.

Figure 3:
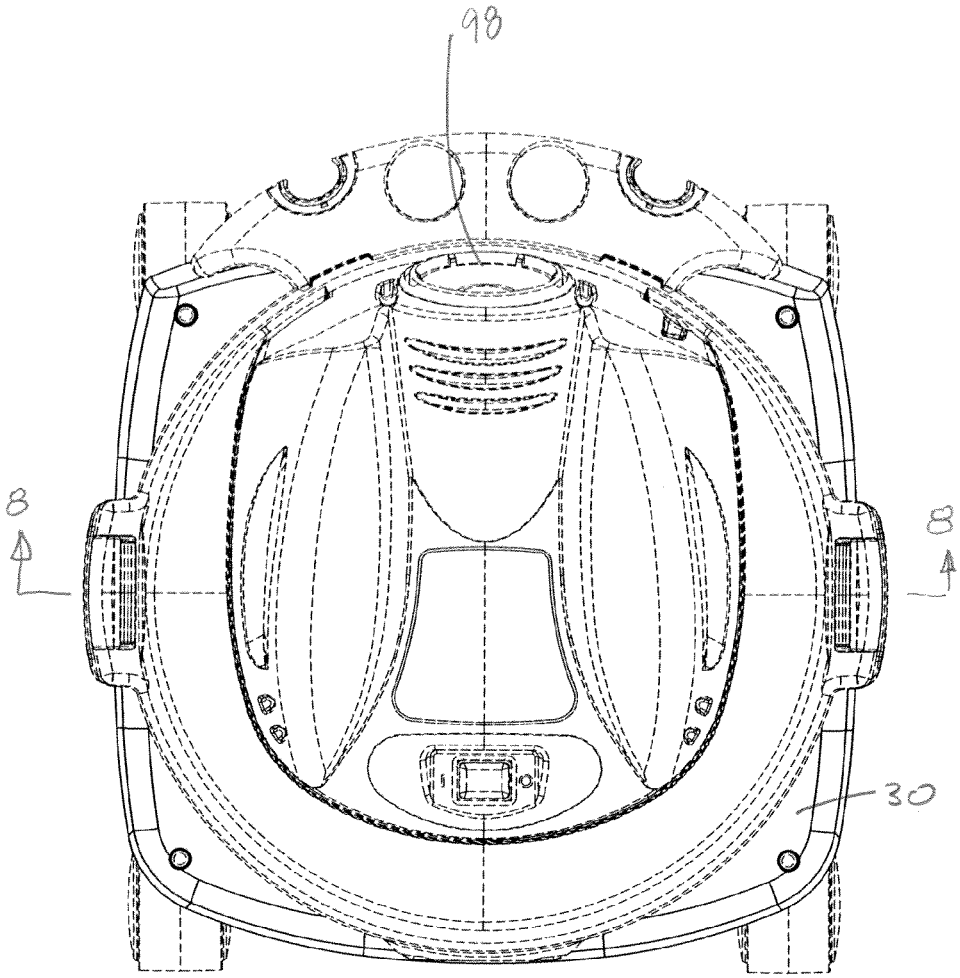
FIG. 3 is a top plan view of the vacuum cleaner.
Figure 4:
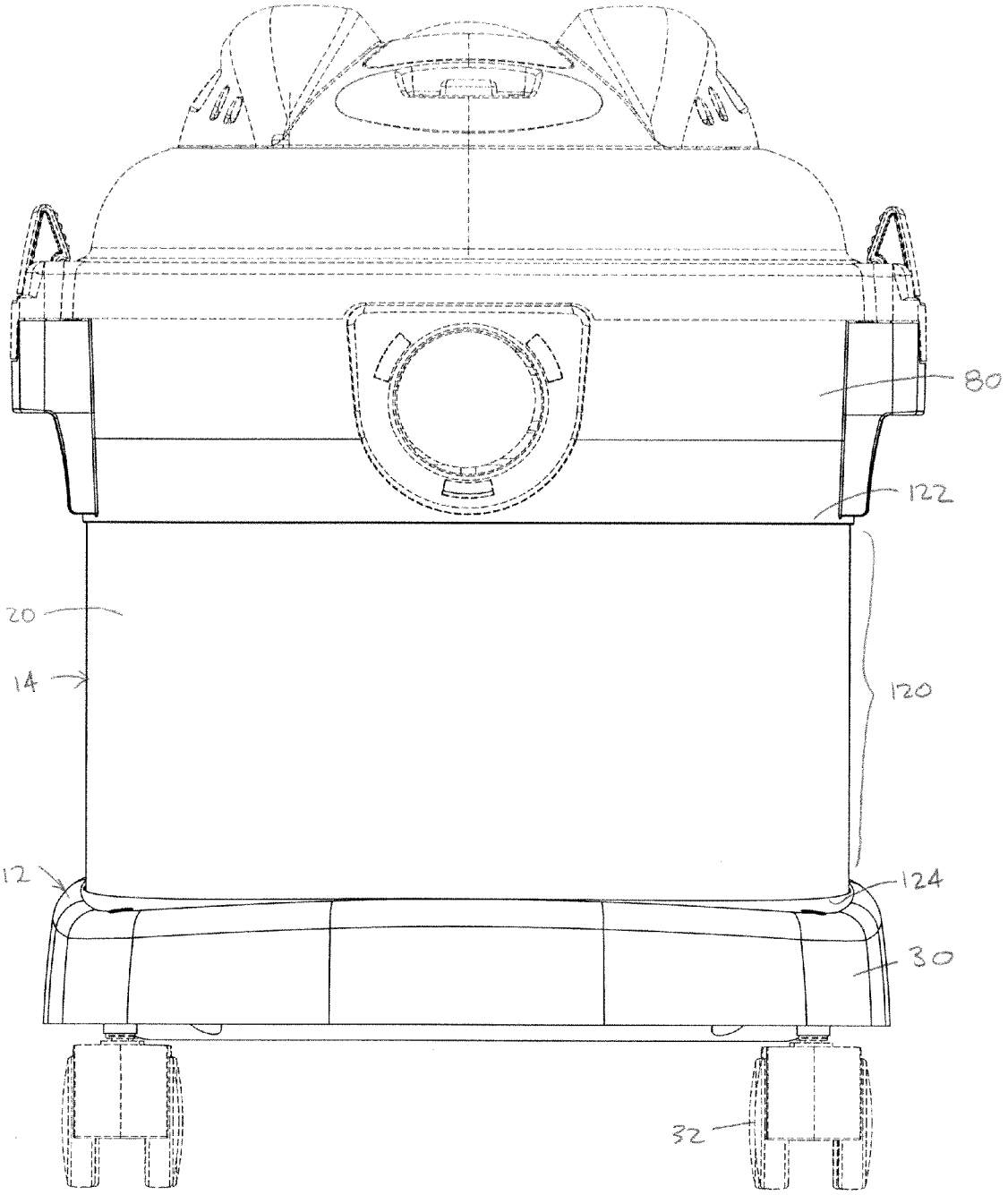
FIGS. 4-6 are front and side elevations of the vacuum cleaner.
Figure 5:
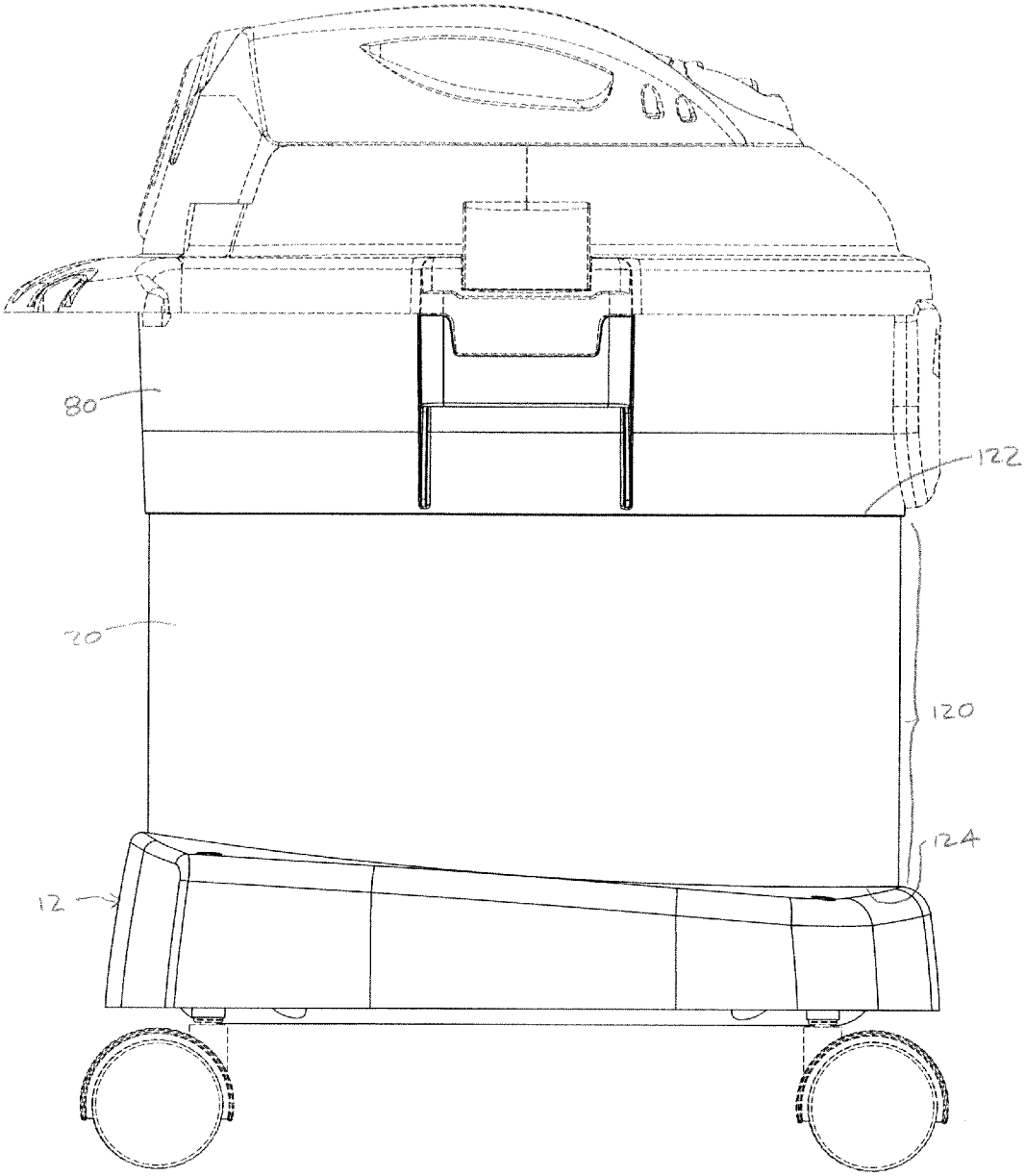
Figure 6:
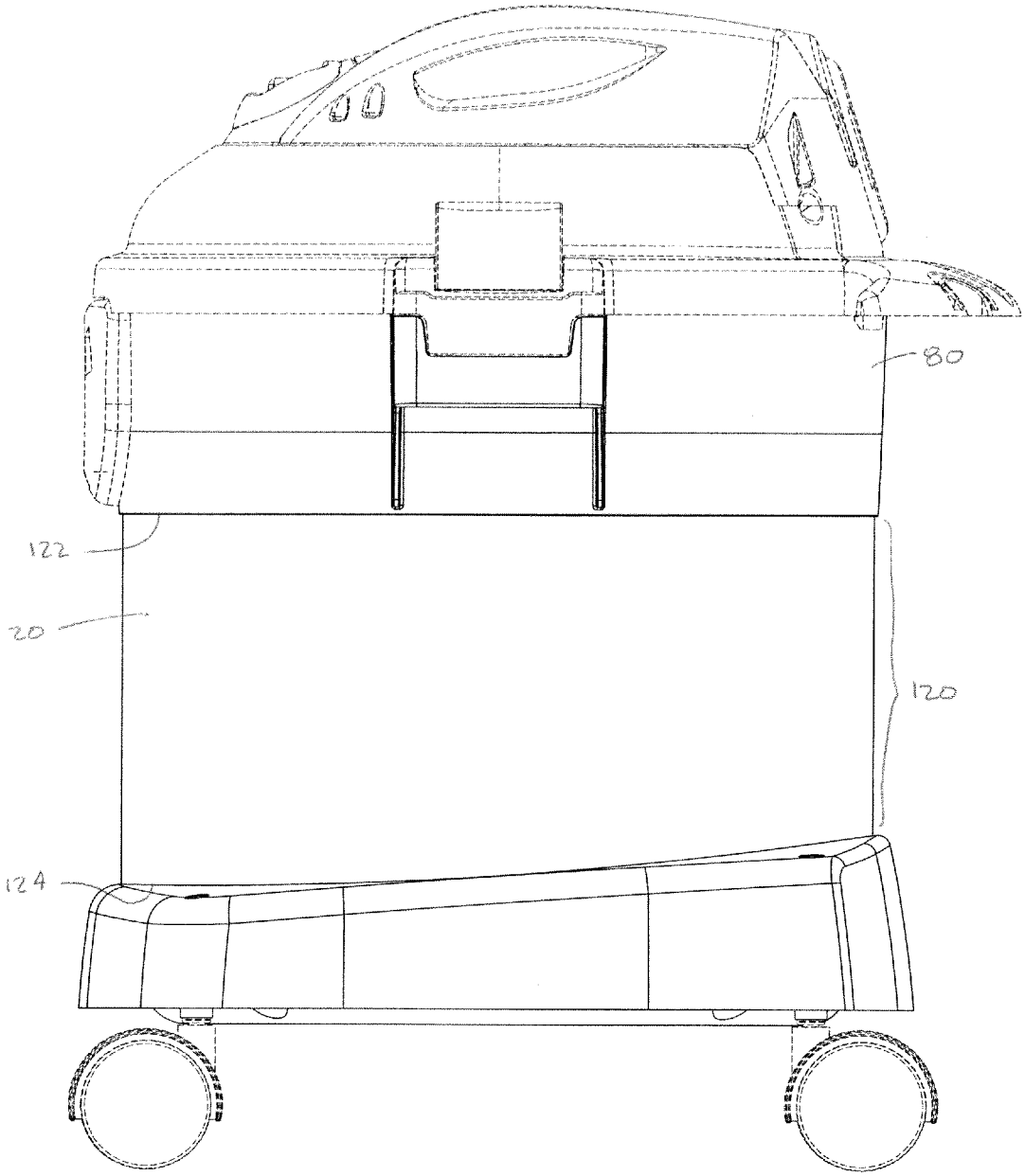
Figure 13:
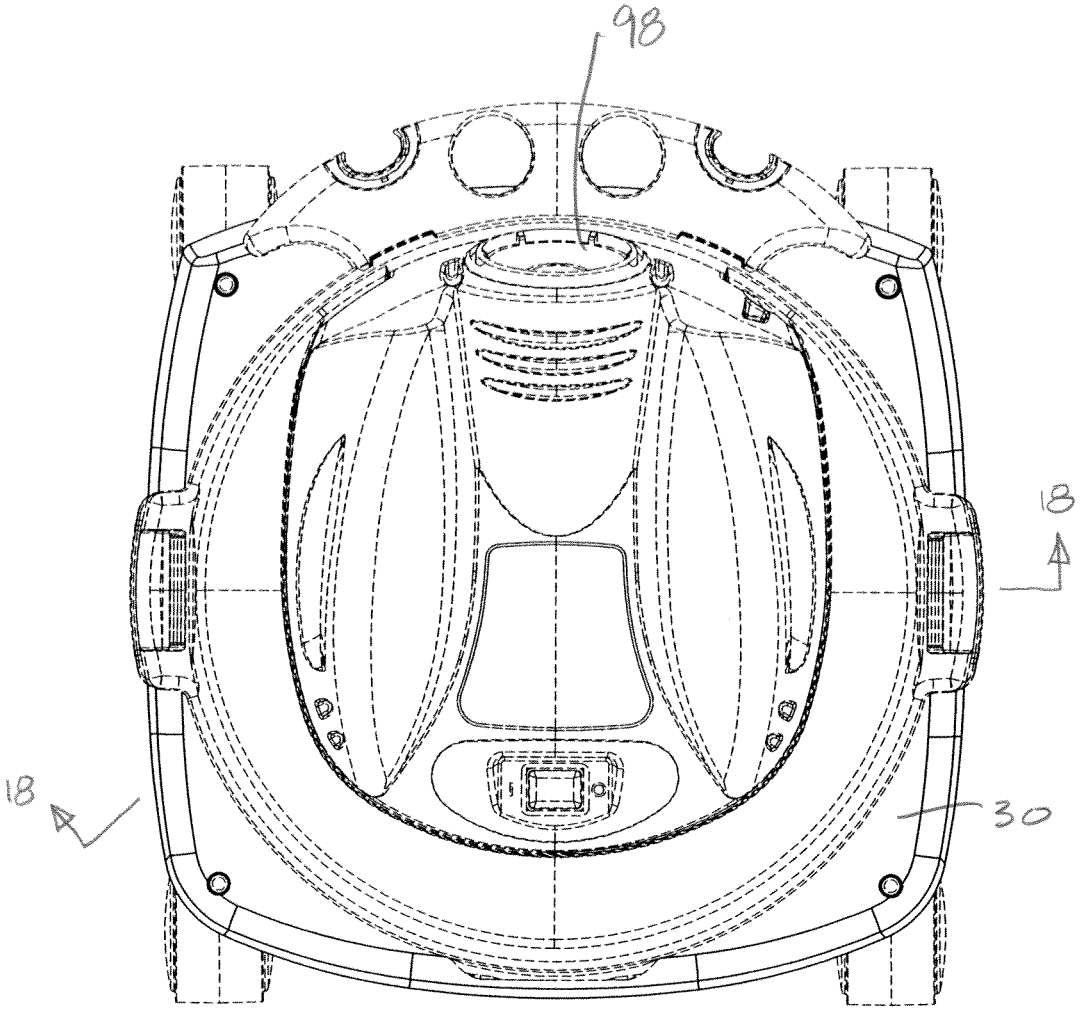
Figure 14:
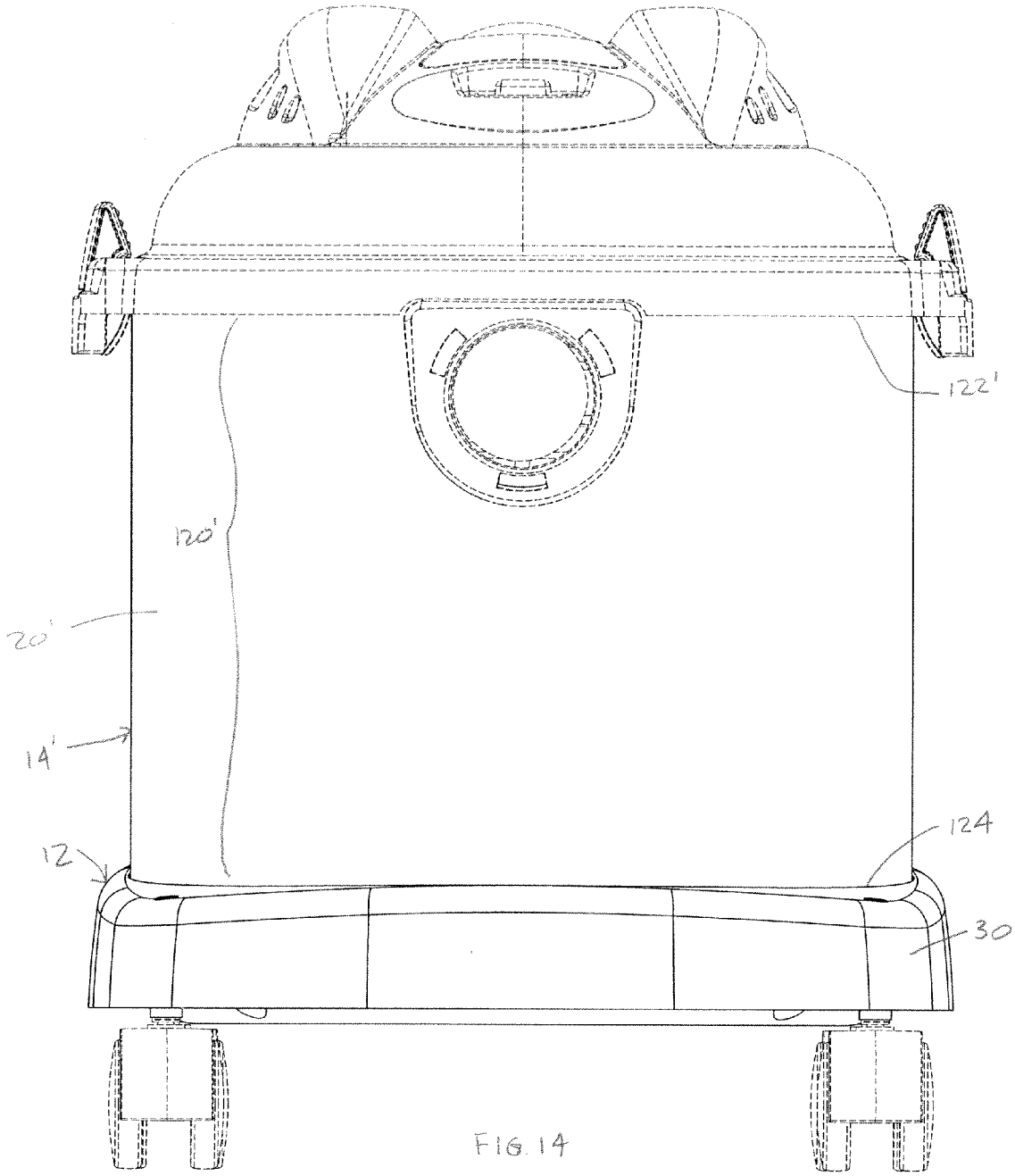
Figure 15:
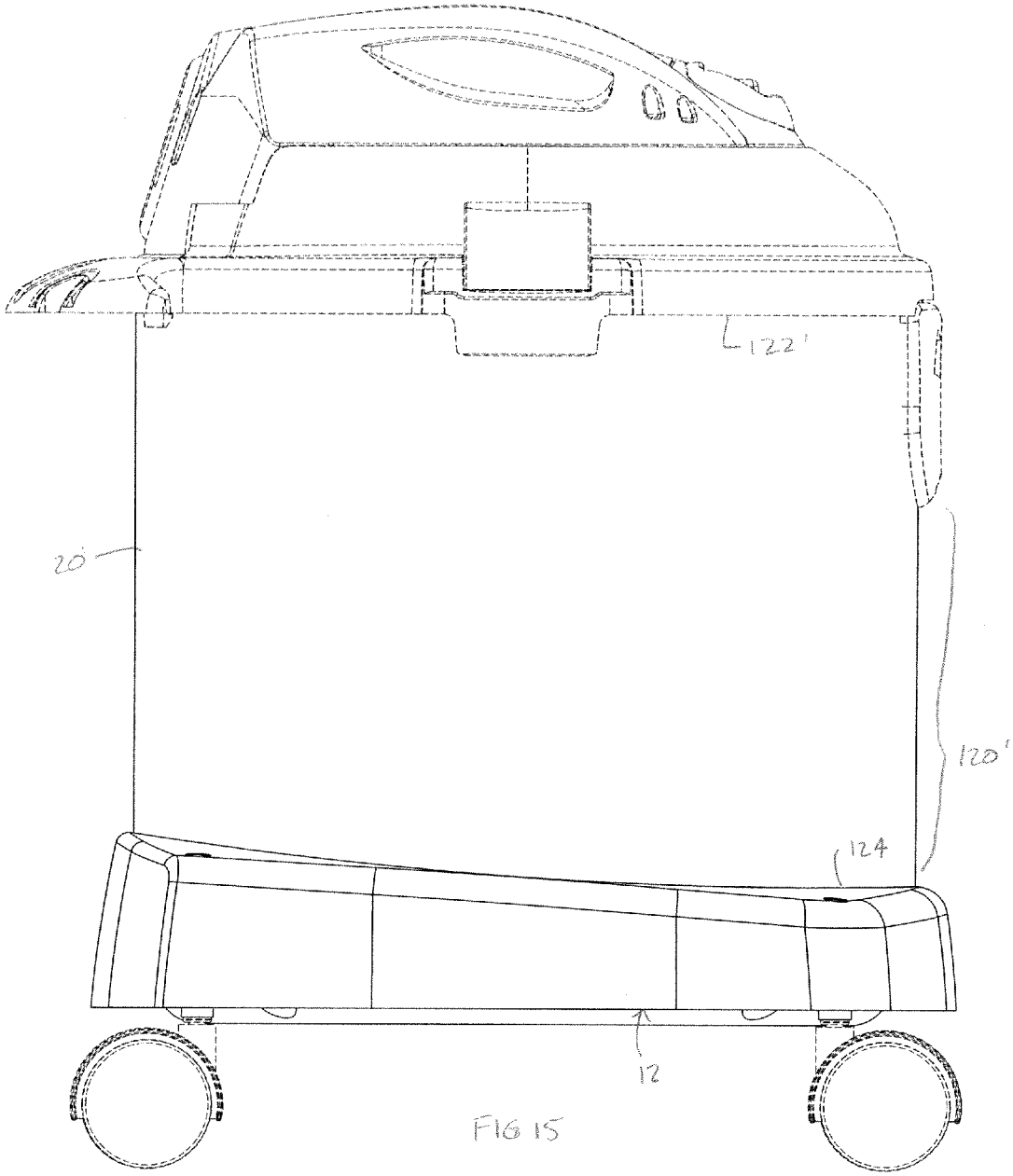
Figure 16:
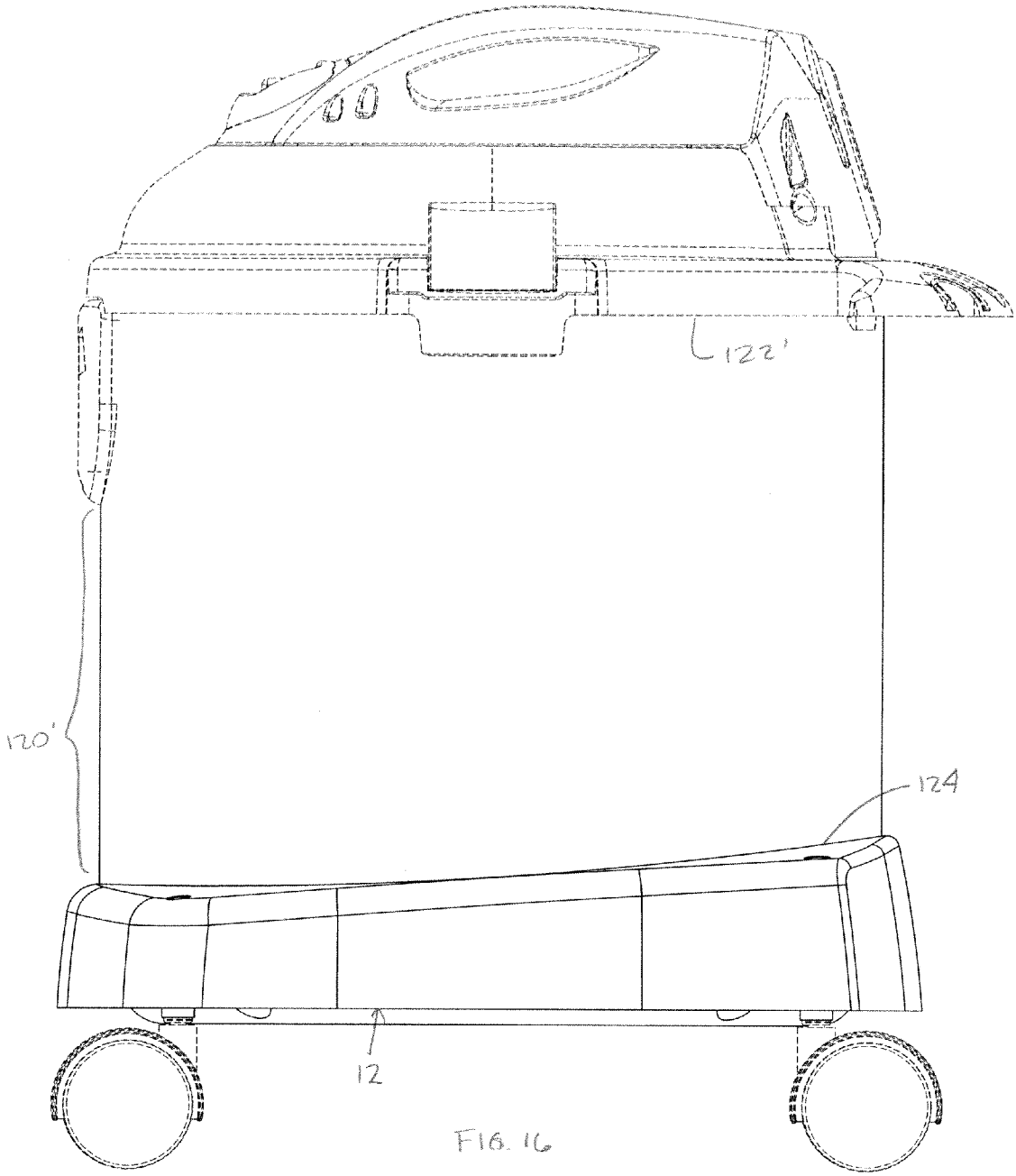
Figure 17:
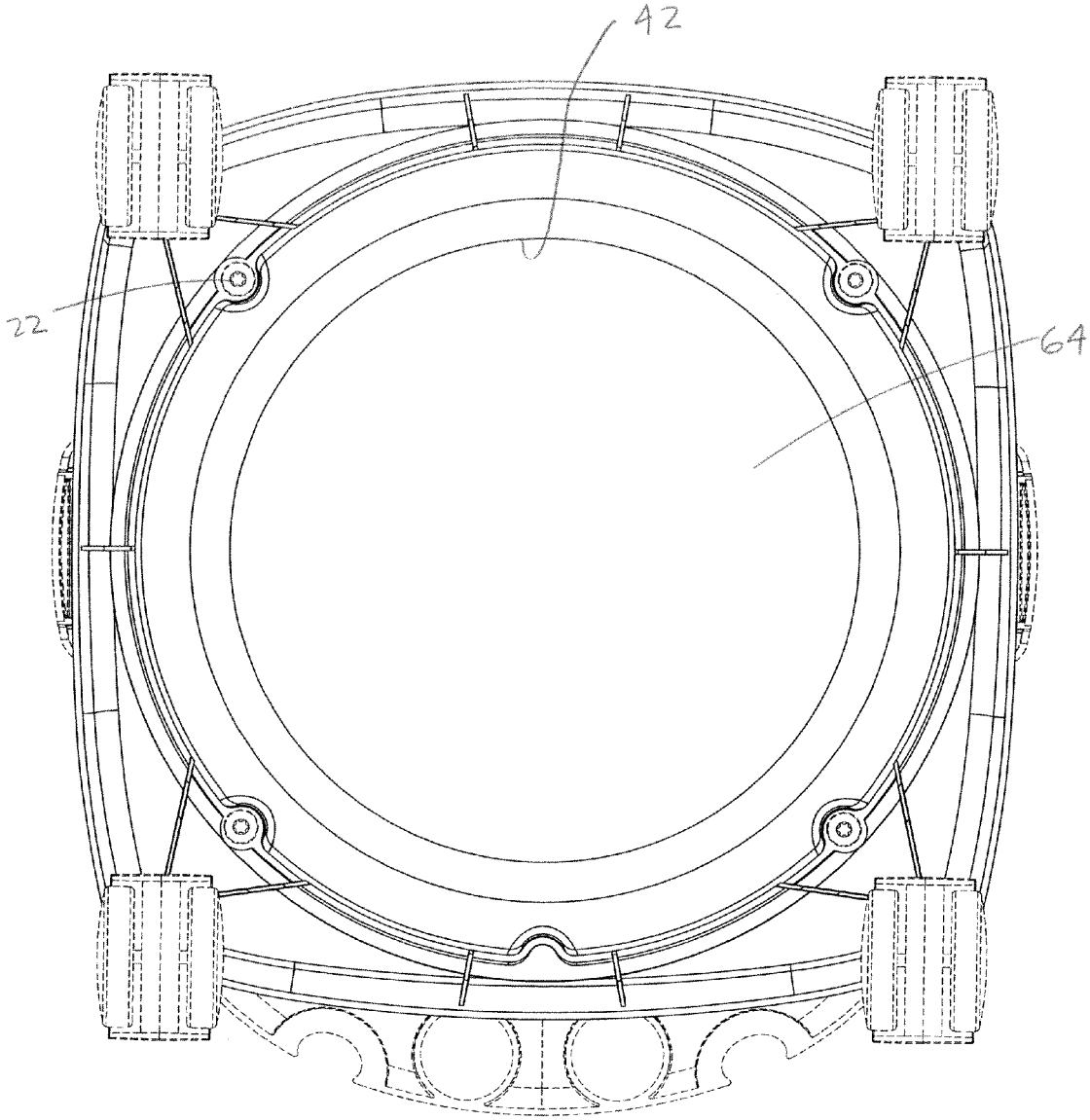

The seat 30 that is made of molded plastic. As seen in FIGS. 3 and 13, it has a generally square footprint, and is 10-15 inches wide. As seen in FIGS. 4-6 and 14-16, the seat is approximately 2¼ inches tall in front, and approximately 3 inches tall in back. The taller height in back provides more support for the tank 14 or 14' when the vacuum cleaner 10 is pushed forward.

Four conventional wheels 32 are mounted beneath the outer corners of the illustrated seat 30. These wheels enable the base 12 to roll across a floor. As is well-known in the art, each of the illustrated wheels is part of one of four pivoting casters. The wheels of the casters each rotate about a distinct horizontal axis of rotation and each of the axes of rotation can be rotated within the horizontal plane about a vertical (or semi-vertical) axis. This preferred arrangement enables each wheel to roll in any direction with respect to the base. In other embodiments, one or more fixed wheels (that do not rotate about a vertical axis) can also be used instead of one or more of the casters. Other types of rollers can also be used, including those that do not have a distinct horizontal axis of rotation, such as ball bearings.

As best seen in FIGS. 2 and 12, the base 12 has a supporting face 40 that supports the tank section 14. The illustrated supporting face is positioned at the bottom of a recess 42 that is formed in the upper surface 44 of the seat 30. In these examples, the recess extends downwardly from the upper surface of the seat, and has a circular cross section when viewed from above. The illustrated recess is approximately 10-13 inches in diameter and approximately ⅛ inches deep in front and 1 inch deep in back, with sides that are vertical or nearly vertical. The illustrated recess is centered in the upper surface of the seat, but the arrangements and details could be varied.

The supporting face 40 extends inwardly from an inward-facing wall 50 on the recess 42. In the illustrated example, the supporting face lies on a horizontal plane that is approximately 1¾ inches above the bottom of the seat 30, and is part of a rim 52 that is approximately ⅝ inches in height. The supporting face extends inwardly ⅛-¼ inches from the inward-facing edge on the recess. A series of optional tabs 54 can be used to provide greater surface area for support. In the illustrated example, the tabs are approximately ⅝ inches wide, and extend about ½ inch inwardly from the inward-facing wall of the recess.

The Tank Section

Figure 10:
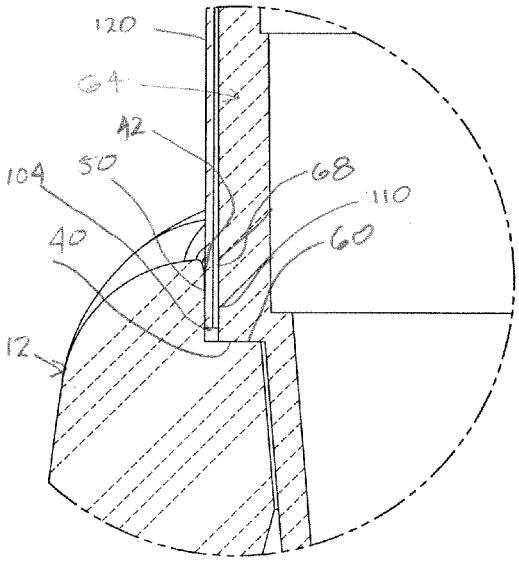
FIG. 10 is an enlarged fragmentary view of the area marked "10" in FIG. 8.
Figure 20:
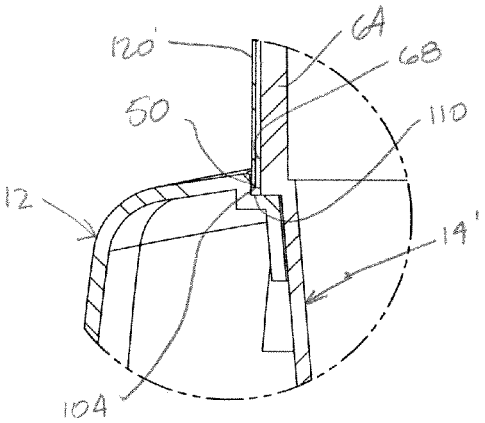

The tank section 14 forms the reservoir that is used to store debris or liquid collected by the vacuum cleaner 10. The tank section is supported by the base 12 with a lower portion of the tank section fitting within the recess 42 in the base. As best seen in FIGS. 10 and 20, a ledge 60 on the tank section rests upon the supporting face 40 on the base. The illustrated ledge is positioned approximately 2 inches above the bottom of the tank section, and is approximately ⅛ inches wide in the horizontal direction. In other arrangements, the bottom of the tank section could also be used as a ledge.

As best seen in FIGS. 2 and 12, the tank section 14 or 14' in the illustrated vacuum cleaners 10 and 10' has a molded inner tank 64 or 64' that provides the primary structural strength for supporting the vacuum head 16 and bounds the reservoir in which debris is retained. Although other arrangements are possible, the illustrated molded inner tanks are made of ⅛ inch thick molded plastic, and have a generally rounded profile with a bottom outside diameter of approximately 11½ inches, holding a volume of 5 or 6 gallons. The size and shape of the molded inner tank can vary.

As seen in FIGS. 10 and 20, when the tank section 14 of 14' is seated within the recess 42 in the base 12, lower portions of an outward-facing edge 68 on the molded inner tank 64 face the inward-facing wall 50 on the recess. As seen in FIGS. 2 and 12, inwardly-curving bends 70 near the bottom of the tank section are sized to accommodate the optional tabs 54 in the seat 30.

Figure 7:
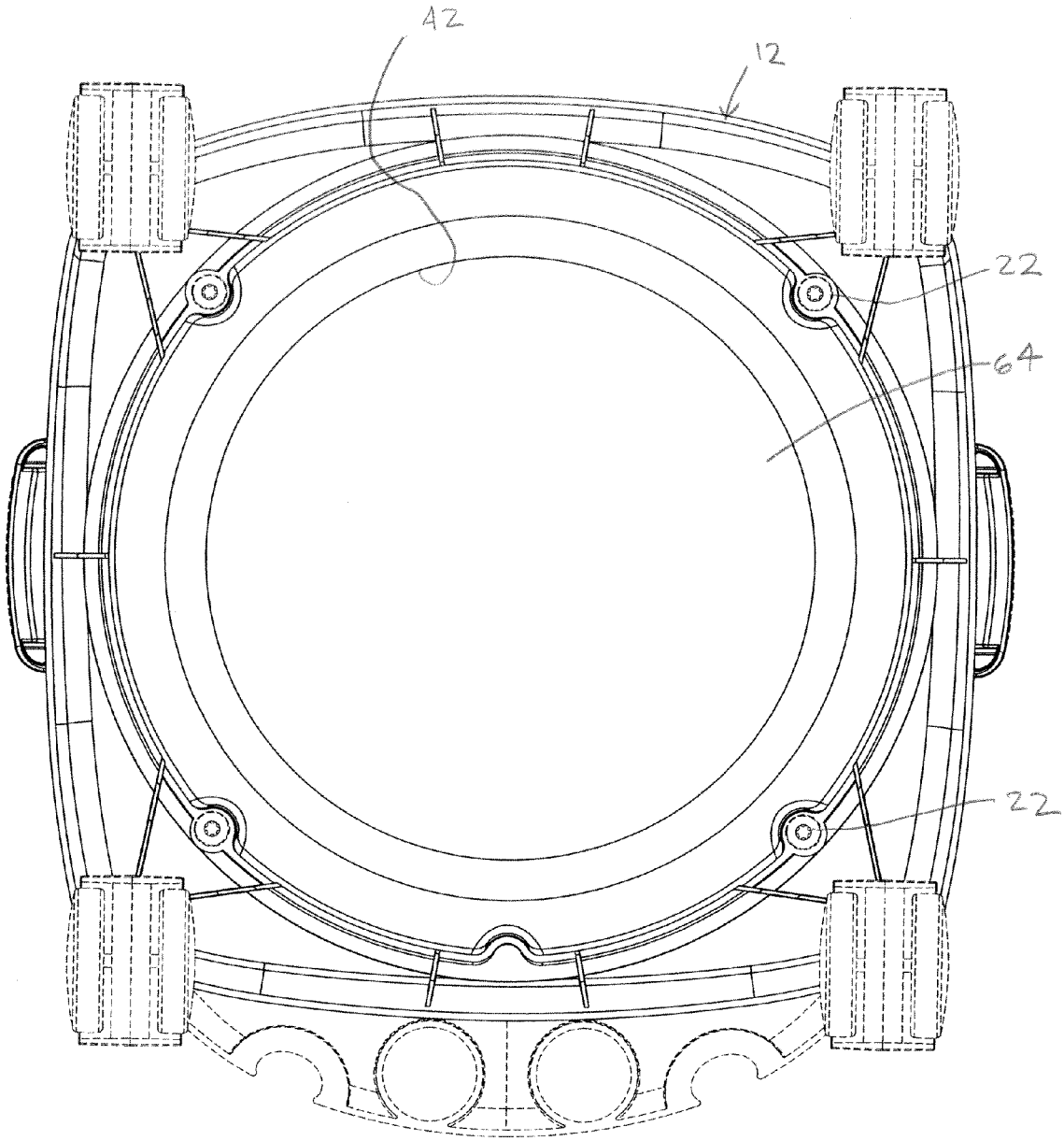
FIG. 7 is a bottom view of the vacuum cleaner.

The illustrated tank section 14 or 14' is secured to the base 12 by the connectors 22. The illustrated connectors are ¾ inch long screws that extend upwardly though holes 72 in the tabs 54 in the base and into the supporting face 40 on the tank section. As seen in FIG. 7, this arrangement provides easy access to the heads of the connectors though the bottom of the vacuum cleaner 10. Other type of connectors and other arrangements can also be used.

The sides of the molded inner tank 64 or 64' are closest together at the bottom of the tank section 14 or 14' and taper slightly outwardly from the ledge 60 toward a tank collar 80 or 80' at the top of the tank section, seen in FIGS. 2 and 12. During manufacturing, this taper in width facilitates removal of the molded inner tank from a mold. Preferably, the difference in outside width from top to bottom of the molded inner tank is less than 0.3 inches.

In the vacuum cleaner 10 seen in FIGS. 1-10, the tank collar 80 is approximately 3¾ inches tall. The molded inner tank 64 is about 6 inches tall from the ledge 60 to the tank collar, and is 0.02-0.03 inches narrower at the ledge than it is at the point where the molded inner tank joins the tank collar. In the vacuum cleaner 10' seen in FIGS. 11-20, the molded inner tank is about 9-12 inches tall from the ledge 60 to the tank collar.

The tank collar 80 or 80' provides a transition between the upright sides of the tank section 14 or 14' and the vacuum head 16, and provides a convenient base for the inlet 18 and latches 84 that are used to hold the vacuum head to the tank section. The illustrated tank collars each have a standard upper rim 88 upon which the vacuum head 16 can be secured in the usual way, such as by the conventional latches seen in the figures. The tank collar is slightly wider than the molded inner tank 64, and extends radially outwardly from the top of the molded inner tank.

Each of the two illustrated tank collars 80 and 80' is made of molded plastic. In some vacuum cleaners, including the ones illustrated here, the collar and the molded inner tank can be molded simultaneously as a single unit. Alternatively, the tank collar and molded inner tank could be formed separately and joined together in any conventional way.

As best seen in 8, 9, 18, and 19, each of the illustrated tank collars 80 and 80' has a downward-opening slot 90 or 90' that is used for securing the metal wall 20 or 20'. This slot is formed at the junction between the outward-facing edge 68 on the molded inner tank 64 or 64' and the bottom of the tank collar, and is generally cylindrical. The illustrated downward-opening slots are approximately 3/32 inches deep (in the vertical direction) and approximately 1/32 inches wide (in the horizontal direction). This depth is preferred for the illustrated arrangements; the width is selected to be slightly wider than the thickness of the metal wall. Tapered edges on the slot help to facilitate assembly, which will be discussed in a later section about the metal wall 20.

The slot 90 for the vacuum cleaner 10 seen in FIGS. 1-10 extends all the way around the circumference of the tank section 14. On the other hand, the slot 90' for the vacuum cleaner 10' seen in FIGS. 11-20 does not extend all the way around the tank section 14', but does span an arc of more than 300 degrees, extending all the way to the opposed sides of the inlet 18.

The Vacuum Head

Figure 8:
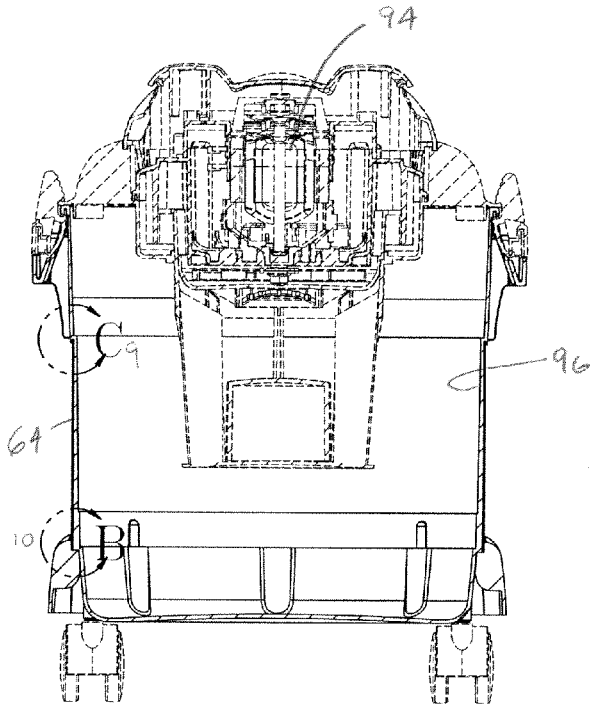
FIG. 8 is a cross-sectional side view of the vacuum cleaner through section 8-8 in FIG. 3.
Figure 18:
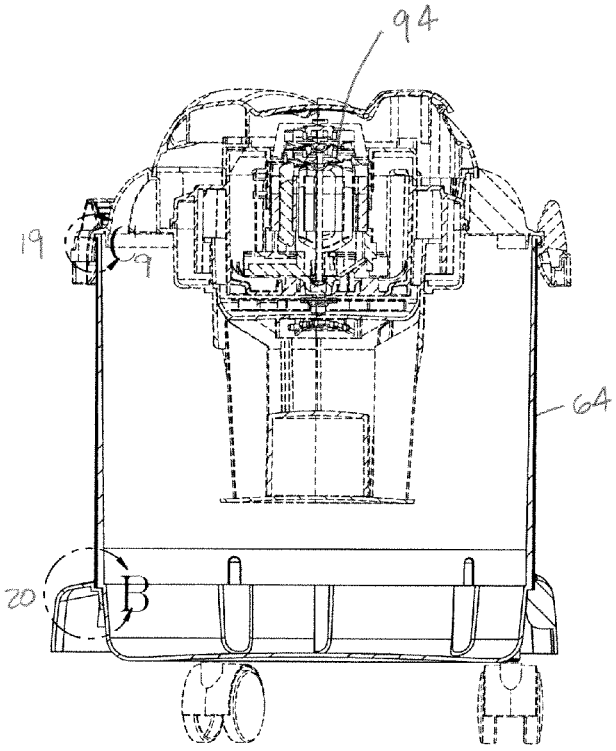

The vacuum head 16 houses the working components of the vacuum cleaner 10. The illustrated vacuum head is removably attached to the upper rim 88 on the tank collar 80 or 80' on the tank section 14 or 14'. The illustrated vacuum head is a conventional one, and, as seen in FIGS. 8 and 18, includes a vacuum source 94 that is connected to the vacuum head. The vacuum source is in fluid communication with the vacuum inlet 18, and draws a dirty air stream into the vacuum cleaner through that inlet. The vacuum source is also is fluid communication with the reservoir 96 within the molded inner tank 64 or 64', where, as stated above, the dirt and debris from the dirty air stream are collected. After the dirt and debris are removed from the airstream, cleaned air is exhausted through an exhaust outlet 98, seen in FIGS. 3 and 13. In this example, the exhaust outlet is formed on the vacuum head.

While this illustrated arrangement of the vacuum head is conventional, many modifications are known and can also be used.

The Metal Wall

The metal wall 20 or 20' of the illustrated vacuum cleaners 10 and 10' give the vacuum cleaner a durable and rugged appearance. The illustrated metal walls are made of a sheet of 0.028 inch thick stainless steel that is between 36 and 40 inches wide. Other thicknesses of metal, such as thicknesses from 0.023-0.033 inches, may be particularly suitable for a given vacuum cleaner. Preferably, a metal sheet with uniform gauge is used to create the metal wall. This minimizes cost, but is not always required. The illustrated metal walls are formed into a cylinder by connecting lateral sides of the sheet together. This connection can be made in any suitable way, such as by crimping, using an adhesive, welding, or mechanical fasteners. Preferably, the cylinder is formed with a single vertical seam. This helps to provide a pleasing aesthetic appearance. In some contexts, however, this would not be required.

Figure 9:
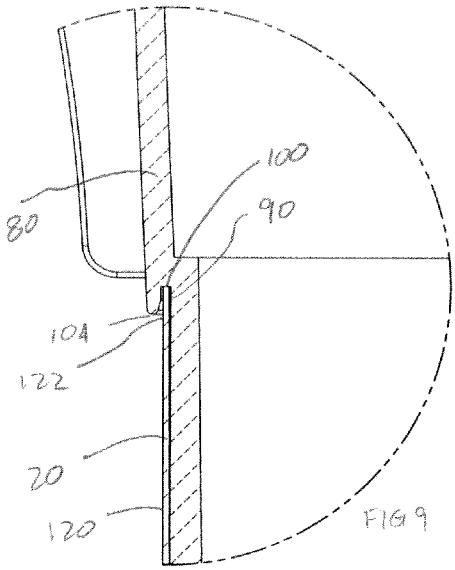
FIG. 9 is an enlarged fragmentary view of the area marked "9" in FIG. 8.
Figure 19:
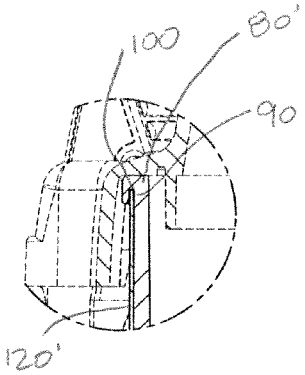

The metal wall 20 or 20' is mounted on the vacuum cleaner 10 or 10' so that it substantially surrounds the molded inner tank 64 or 64'. In these examples, the metal wall completely surrounds the molded inner tank, but equivalent vacuum cleaners could also be made using a wall that does not have joined lateral ends and does not completely surround the molded inner tank. As seen in FIGS. 9 and 19, the upper edge 100 or 100' of the metal wall fits against the tank collar 80 or 80'. In these examples, the upper edge of the metal wall fits in the downward-opening slot 90 or 90' in the tank collar. In some contexts, that would not be required.

The height of the metal wall 20 or 20' is selected so that, when the vacuum cleaner 10 or 10' is assembled, there is ⅛-1/16 inch clearance between the upper edge 100 of the metal wall and the top of the downward-opening slot 90 or 90', and that clearance is less than the depth of the downward-opening slot. This results in the top of the metal wall being concealed in the downward-opening slot, but still provides adequate tolerance to account for improper fit, irregular edges, etc. that might be expected with production techniques commonly in use at this time. In the vacuum cleaner 10 seen in FIGS. 1-10, the metal wall 20 is approximately 6 inches tall. In the vacuum cleaner 10' seen in FIGS. 11-20, the metal wall is approximately 9¼ inches tall. As noted above, the illustrated metal wall is 0.028 inches thick, and is approximately 0.002 inches thinner than the top of the downward-facing slot. It is preferred that the metal wall fit closely in the downward-opening slot, and this spacing provides adequate tolerance in the illustrated vacuum cleaners.

As seen in FIGS. 10 and 20, the lower edge 104 of the metal wall 20 or 20' fits within the recess 42 in the base 12. Specifically, the lower edge of the metal wall fits into an upward-opening slot 110 between the inward-facing wall 50 of the recess on the base 12 and the outward-facing edge 68 on the molded inner tank 64 of the tank section 14 or 14'. The lower edge is supported by the supporting face 40 on the base. In these examples, the inward-facing wall on the base takes the form of an annular ring that has an inside diameter that matches or is just slightly greater than the outside diameter of the metal wall 20 or 20' and is between ⅛ and 1 inch tall. The corresponding outward-facing wall on the molded inner tank is also an annular ring, and has an outside diameter of 11¾ inches, leaving a gap of approximately ⅛ inches in which the lower edge of the metal wall can be seated.

The various parts of the illustrated vacuum cleaner 10 can be assembled in two ways. One way involves first setting the lower edge 104 of the metal wall 20 into the recess 42 in the base 12, and then setting the tank section 14 into the recess and securing the tank section to the base. The alternative way involves first setting the upper edge 100 of the metal wall into the downward-opening slot in the tank section, and then setting the tank section and the metal wall into the recess in the base and securing the parts in place.

Either way, once the tank section 14 is secured to the base 12, the position of the top of the downward-opening slot 90 or 90' is fixed with respect to the position of the upward-opening slot 110. Similarly, a lower edge 104 or 104' of the downward-opening slot is fixed with respect to the upward-opening slot. The distance between the lower edge of the downward-opening slot and the top of the upward-opening slot exceeds the height of the metal wall 20 or 20'. Thus, when the molded inner tank 64 or 64' is secured to the base, the metal wall is trapped in place between the tank collar and the base.

As seen in FIGS. 1 and 11, when the vacuum cleaner 10 or 10' is assembled, an exposed stainless steel section 120 or 120' of the metal wall 20 or 20' is visible to view by purchasers and users. Although other arrangements are possible, in the illustrated vacuum cleaners this exposed section has a horizontal upper boundary 122 or 122', has a lower boundary 124 that adjoins the base 12, and is free of any visible connectors (such as screws) that might suggest the presence of an inner tank and thus detract from the appearance of the vacuum cleaner by suggesting that the metal wall is merely a facing.

In the illustrated vacuum cleaners, the upper boundary 122 or 122' of the exposed stainless steel section 120 is at the juncture where the metal wall 20 or 20' enters the downward-opening slot 90 or 90', and is approximately ⅛-¼ inches beneath the upper edge 100 or 100' of the metal wall. In other vacuum cleaners, or at particular locations, the upper boundary might be inches beneath the upper edge of the metal wall. The lower boundary 124 is at the juncture where the metal wall 20 or 20' leaves the upward-opening slot 110, ¼-½ inch above the lower edge 104 of the metal wall at the front of the vacuum cleaner. In other vacuum cleaners, and at other locations, this juncture might be an inch or more above the lower edge of the metal wall.

The vacuum cleaner 10 seen in FIGS. 1-10 uses a metal wall 20 that requires minimal cutting.

The vacuum cleaner 10' seen in FIGS. 11-20 is arranged differently, and has more exposed metal. As best seen in FIG. 12, in this product a concavity 130 is cut in the metal wall 20' to accommodate the inlet 18. Using a concavity enables the metal to be extended higher up on the tank section, and may provide an even more pleasing aesthetic appearance. When the vacuum cleaner 10' is assembled, the cut edges of the concavity are covered by a flange 132 on the inlet. Similar concavities could be cut in the metal wall to accommodate latches that extend farther down on the tank section than the illustrated latches 84. However, because the metal must be cut to form a concavity, this arrangement may require additional cost and a possible waste of raw material.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A vacuum cleaner that has:

a base that rolls;

a tank section that is carried by the base;

a vacuum head that is removably attached to an upper part of the tank section;

a molded inner tank that forms a lower part of the tank section and connects to the base;

a vacuum source that is connected to the vacuum head and is in fluid communication with a reservoir within the molded inner tank;

a vacuum inlet that is in fluid communication with the vacuum source;

an exhaust outlet that is in fluid communication with the vacuum source;

a tank collar that extends radially outwardly from the molded inner tank and forms a downward opening slot; and a metal wall that has a thickness of between 0.02 and 0.035 inches, substantially surrounds the molded inner tank, has an upper edge that fits within the downward-opening slot against the tank collar, has a lower edge that fits within an upward-opening slot formed between a recess in the base and the molded inner tank, and is trapped in place between the tank collar and the base when the molded inner tank is connected to the base wherein the upward-opening slot is substantially aligned with the downward-opening slot.

2. A vacuum as recited in claim 1, in which the metal wall is cylindrical.

3. A vacuum cleaner as recited in claim 1, in which the metal wall is cylindrical and has a uniform gauge and a single, vertical seam.

4. A vacuum cleaner as recited in claim 1, in which the metal wall is made of stainless steel.

5. A vacuum cleaner as recited in claim 1, in which:

the lower edge of the metal wall fits between an inward-facing wall on a recess on the base and an outward-facing edge on the molded inner tank, and is supported by a supporting face on the base that also supports the molded inner tank.

6. A vacuum cleaner as recited in claim 1, in which:

the metal wall has an exposed stainless steel section that is visible to view by purchasers and users when the vacuum cleaner is fully assembled, fully surrounds the molded inner tank, is at least 3 inches in height across its entire width, and has a lower boundary that adjoins the base.

7. A vacuum cleaner as recited in claim 1, in which:

the metal wall has an exposed stainless steel section that is visible to view by purchasers and users when the vacuum cleaner is fully assembled, substantially surrounds the molded inner tank, has an upper boundary that extends to within less than 1" of the vacuum head, has a concavity that partially surrounds the vacuum inlet, and has a lower boundary that adjoins the base.

8. A vacuum cleaner that has:

a base that rolls;

a tank section that is carried by the base;

a vacuum head that is removably attached to an upper part of the tank section;

a molded inner tank that forms a lower part of the tank section and connects to the base;

a vacuum source that is connected to the vacuum head and is in fluid communication with a reservoir within the molded inner tank;

a vacuum inlet that is in fluid communication with the vacuum source;

an exhaust outlet that is in fluid communication with the vacuum source;

a tank collar that has an upper rim forming a downward-opening slot; and an exposed stainless steel section that is visible to view by purchasers and users when the vacuum cleaner is fully assembled, substantially surrounds the molded inner tank, has an upper boundary that extends to within less than 1" of the vacuum head, has a concavity that partially surrounds the vacuum inlet, and has a lower boundary that adjoins the base in which the exposed stainless steel section is part of a cylinder that has an upper edge that fits into the downward-opening slot and a lower edge that fits into an upward-opening slot that is formed between an inward-facing wall on the base and an outward-facing edge on the molded inner tank;

wherein the upward-opening slot is substantially aligned with the downward-opening slot.

9. A vacuum cleaner as recited in claim 8, in which:

the lower edge of the cylinder is positioned beneath the lower boundary of the exposed stainless steel section; and the base has a supporting face that supports both a lower face on the tank section and the lower edge of the cylinder.

10. A vacuum cleaner as recited in claim 8, in which the cylinder has a lower edge that is beneath the lower boundary of the exposed stainless steel section, and is supported by a supporting face on the base that also supports the tank section.

11. A vacuum cleaner as recited in claim 8, in which the inlet has a flange that covers the edge of the concavity.

* * * * *